US007234422B2

(12) United States Patent
Schlautman et al.

(10) Patent No.: US 7,234,422 B2
(45) Date of Patent: Jun. 26, 2007

(54) ENGINE COOLING METHOD AND APPARATUS

(75) Inventors: Jeffrey A. Schlautman, Lapeer, MI (US); Robert J. Moran, Ann Arbor, MI (US); Stephen J. Lever, Peterborough (GB); Andreas Zurk, Weinberg (AT)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/300,248

(22) Filed: Dec. 14, 2005

(65) Prior Publication Data

US 2007/0056535 A1 Mar. 15, 2007

Related U.S. Application Data

(60) Provisional application No. 60/716,667, filed on Sep. 13, 2005.

(51) Int. Cl.
*F02F 1/36* (2006.01)

(52) U.S. Cl. ..... 123/41.74; 123/41.82 R

(58) Field of Classification Search ..... 123/41.82 R, 123/41.72, 41.74; 29/888.06
See application file for complete search history.

(56) References Cited

U.S. PATENT DOCUMENTS 5,765,282 A * 6/1998 Sweetland et al. ..... 29/888.06
7,051,685 B2 * 5/2006 Hayman et al. ..... 123/41.82 R

* cited by examiner

*Primary Examiner*—Stephen K. Cronin
*Assistant Examiner*—Hyder Ali
(74) *Attorney, Agent, or Firm*—John E. Kajander

(57) ABSTRACT

The present invention provides an engine cooling method and apparatus. The engine cooling apparatus includes a cylinder block having a cylinder head mounted thereto. The cylinder block defines an inlet passage and a block jacket in fluid communication with the inlet passage. The cylinder head defines a lower cylinder head jacket in fluid communication with the block jacket, and an upper cylinder head jacket in fluid communication with the lower cylinder head jacket. The lower cylinder head jacket includes a plurality of nozzles configured to direct engine coolant and thereby provide cooling to portions of the cylinder head located near a plurality of exhaust ports, a plurality of injector ports, and a plurality of intake ports.

18 Claims, 3 Drawing Sheets

ENGINE COOLING METHOD AND APPARATUS

CROSS-REFERENCE TO RELATED APPLICATIONS

This application claims the benefit of U.S. Provisional Application 60/716,667 filed Sep. 13, 2005, which is hereby incorporated by reference in its entirety.

TECHNICAL FIELD

The present invention is drawn to an engine cooling method and apparatus.

BACKGROUND OF THE INVENTION

As the power output of internal combustion engines increase, the cooling requirements correspondingly increase. Conventional cooling systems direct coolant flow from the cylinder block to the cylinder head using a cylinder head gasket. It has been observed, however, that some high output engines require additional cooling in specific regions of the cylinder head such as, for example, near the exhaust ports; the injectors; and the intake ports. It has further been observed that conventional cooling systems relying on a cylinder head gasket to direct coolant flow cannot direct enough coolant to the exhaust ports, the injectors, and the intake ports to adequately cool high output engines.

SUMMARY OF THE INVENTION

The present invention is drawn to an engine cooling method and apparatus. The apparatus implements a plurality of nozzles configured to direct coolant to areas of high temperature. According to a preferred embodiment, the nozzles are cast into a cylinder head, and are configured to direct coolant to regions near the exhaust ports; the injectors; and the intake ports.

The engine cooling apparatus includes a cylinder block having a cylinder head mounted thereto. The cylinder block defines an inlet passage and a block jacket in fluid communication with the inlet passage. The cylinder head defines a lower cylinder head jacket in fluid communication with the block jacket, and an upper cylinder head jacket in fluid communication with the lower cylinder head jacket. The lower cylinder head jacket includes a plurality of nozzles configured to direct engine coolant and thereby provide cooling to portions of the cylinder head located near a plurality of exhaust ports, a plurality of injector ports, and a plurality of intake ports.

The method of the present invention includes transferring pressurized engine coolant from an inlet passage defined by the cylinder block into a block jacket defined by the cylinder block. After passing through the block jacket and thereby cooling the cylinder block, the engine coolant is transferred into a plurality of nozzles defined by the cylinder head. The pressurized engine coolant is directed by the nozzle to portions of the cylinder head known to accumulate heat such as the exhaust ports, the injector ports, and the intake ports. Thereafter the pressurized engine coolant is transferred to the upper cylinder head jacket and then out of the engine.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
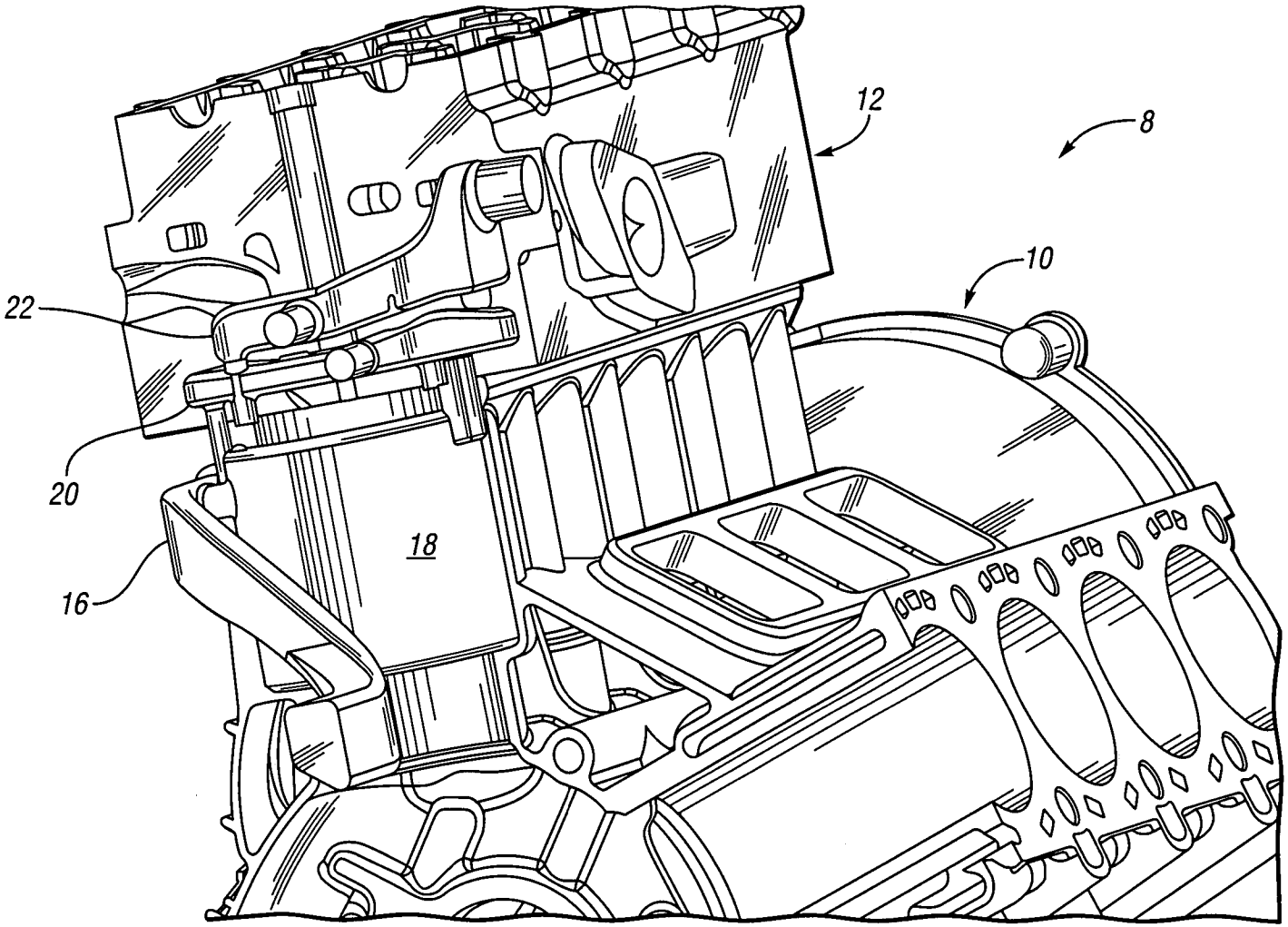
FIG. 1 is a schematic, partially cut-away isometric view of an engine according to the present invention.
Figure 2:
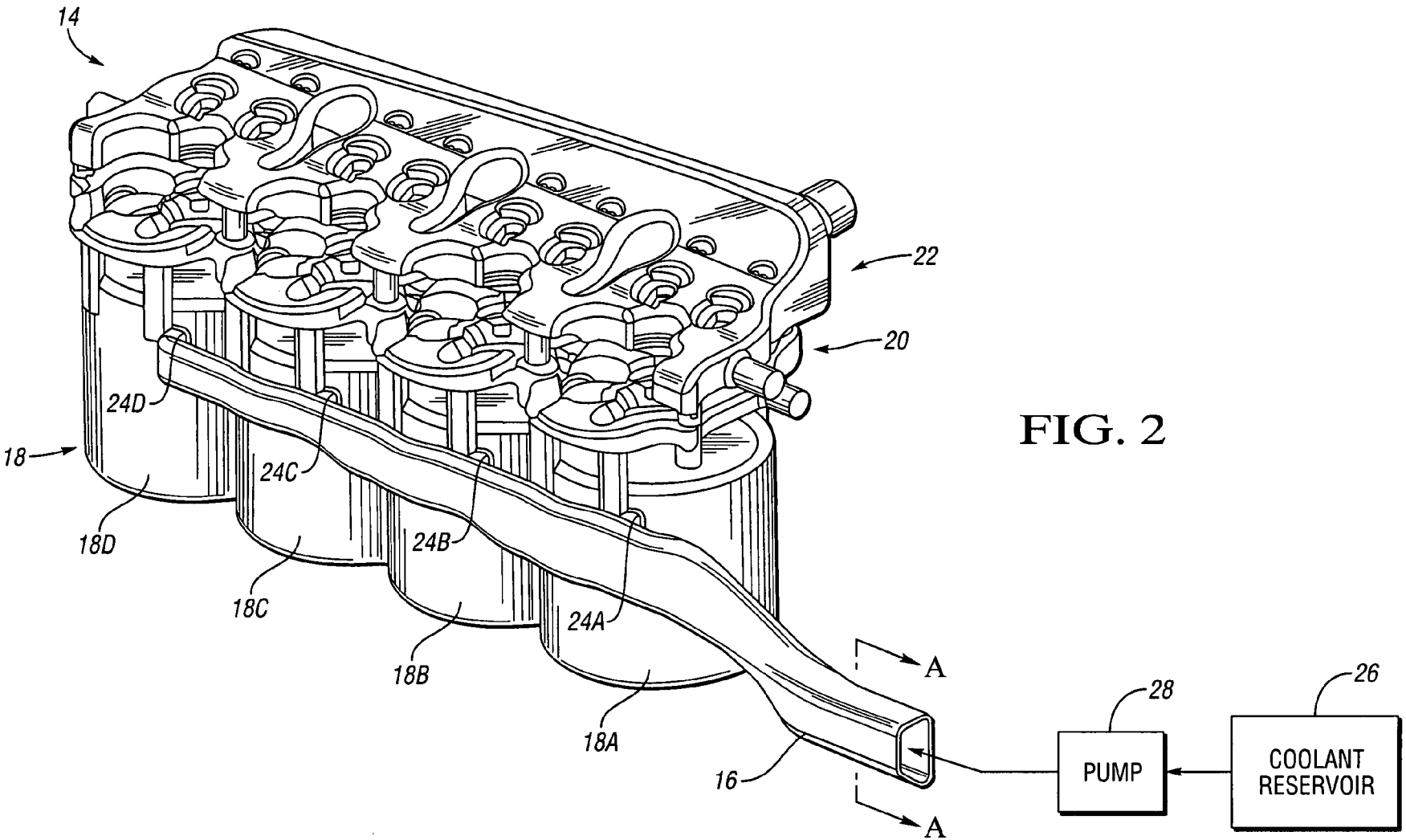
FIG. 2 is a schematic, isometric view of the left half of a cooling apparatus according to the present invention.
Figure 3:
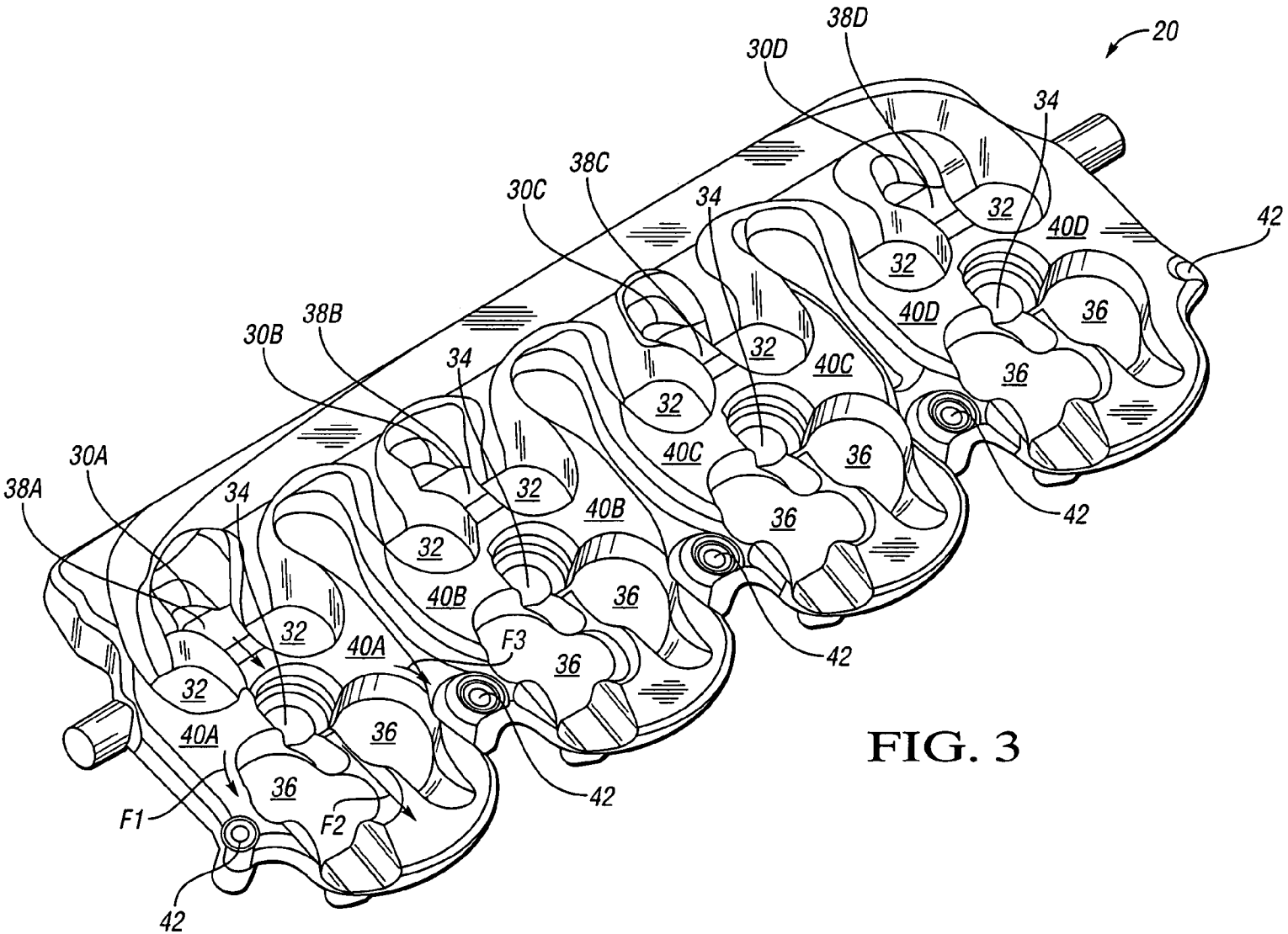
FIG. 3 is a schematic plan view of a lower cylinder head jacket of the cooling apparatus of FIG. 2.

Referring to the drawings, wherein like reference numbers refer to like components, FIG. 1 shows a partially cutaway view of an engine 8 including a cylinder block 10 and a cylinder head 12. The cylinder block 10 and cylinder head 12 define a cooling apparatus 14 (best shown in FIG. 2). More precisely, the cylinder block 10 defines an inlet channel 16 and a block jacket 18 of the cooling apparatus 14, and the cylinder head 12 defines a lower cylinder head jacket 20 and an upper cylinder head jacket 22 of the cooling apparatus 14. The illustrations of the cooling apparatus 14 including the inlet channel 16, block jacket 18, lower cylinder head jacket 20 and the upper cylinder head jacket 22 as shown in FIGS. 1–3 are negative images representing in solid form a series of channels or cavities formed in the engine 8. For purposes of the present invention, a "jacket" is a cavity or flow passage adapted to facilitate the transfer of engine coolant to thereby cool the engine 8. According to a preferred embodiment, the inlet channel 16 and the block jacket 18 are integrally cast into the cylinder block 10, and the upper and lower cylinder head jackets 22, 20 are integrally cast into the cylinder head 12.

Referring to FIG. 2, the left half of the cooling apparatus 14 is shown as it would be applied to the left half of an 8-cylinder engine. It should be appreciated that the cooling apparatus 14 includes a generally symmetrical a right half (not shown) that is applied to the right half of an 8-cylinder engine, and that the cooling apparatus 14 may also be adapted to accommodate alternate engine configurations. The left and right halves of the cooling apparatus 14 functions similarly, and therefore only the left half of the cooling apparatus 14 will hereinafter be described. It should also be appreciated that the cooling apparatus 14 is composed of a plurality of channels and cavities formed in the engine 8 (shown in FIG. 1). For illustrative purposes, FIG. 2 depicts only the channels and cavities of the cooling apparatus 14 without showing the remainder of the engine 8.

The left half of the block jacket 18 shown in FIG. 2 is composed of four generally cylindrical chambers 18A–18D that are configured to cool the cylinder block 10 of the engine 8 and to transfer pressurized coolant to the lower cylinder head jacket 20. A right half of the block jacket 18 (not shown) includes four more generally cylindrical chambers (not shown). Each of the cylindrical chambers 18A–18D are in fluid communication with the inlet channel 16 via conduits 24A–24D, respectively. The conduits 24A–24D are preferably cylindrical and have a common diameter D.

The inlet channel 16 is disposed in fluid communication with the cylindrical chambers 18A–18D, and with a coolant reservoir 26. A pump 28 is preferably implemented to transfer coolant from the coolant reservoir 26 to the inlet channel 16. According to a preferred embodiment, a cross-sectional area of the inlet channel 16, such as that taken through section A—A, decreases along the length of the inlet channel 16 and in a downstream direction. The tapered geometry of the inlet channel 16 is preferred in order to maintain a generally constant velocity of the engine coolant transferred to each of the cylindrical chambers 18A–18D.

Referring to FIG. 3, the lower cylinder head jacket 20 is shown in more detail. The pressurized coolant is received by the lower cylinder head jacket 20 from the block jacket 18 via a plurality of nozzles 30A–30D defined by the cylinder head 12 (shown in FIG. 1). For purposes of the present invention, the terms nozzle and channel may be used interchangeably. According to a preferred embodiment, the nozzles 30A–30D taper down so that the inlet diameter is greater than the outlet diameter and the velocity of the fluid exiting the nozzles is correspondingly increased. It should, however, be appreciated that alternate nozzle configurations may be envisioned such as, for example, a constant diameter nozzle. The nozzles 30A–30D are preferably integrally cast into the cylinder head 12, however, the nozzles 30A–30D may alternatively be machined or may be composed of inserts assembled to the cylinder head 12. The cylinder head 12 also defines a plurality of exhaust ports 32, a plurality of injector ports 34, and a plurality of intake ports 36.

The lower cylinder head jacket 20 includes a plurality of transfer channels 38A–38D that are each in fluid communication with one of the nozzles 30A–30D, respectively. The transfer channels 38A–38D are each connected to one of the cavities 40A–40D of the cylinder head jacket 20. The transfer channels 38A–38D are each disposed between two adjacent exhaust ports 34. Each of the cavities 40A–40D partially circumscribe an injector port 34 and an adjacent pair of intake ports 36. The cavities 40A–40D each define a first, second and third flow path F1, F2 and F3, respectively. The flow paths F1 and F3 flow in close proximity to and partially around one of the intake ports 36, and the flow path F2 flows between two adjacent intake ports 36. A plurality of transfer passages 42 are disposed in fluid communication with the cavities 40A–40D of the lower cylinder head jacket 20 and the upper cylinder head jacket 22.

Having described the geometry of the cooling apparatus 14 hereinabove, the function of the cooling apparatus 14 will now be described. Referring again to FIG. 2, the pump 28 draws coolant from the coolant reservoir 26 and transfers it to the inlet channel 16. The inlet channel 16 transfers engine coolant to each of the cylindrical chambers 18A–18D of the block jacket 18. According to a preferred embodiment, the engine coolant is evenly distributed to each of the cylindrical chambers 18A–18D such that each chamber receives approximately 25% of the total engine coolant flow entering the inlet channel 16. The even distribution of coolant flow can be maintained by adjusting the tapered geometry of the inlet channel 16 and/or by varying the diameters of the conduits 24A–24D.

The engine coolant passes from each of the conduits 24A–24D into one of the cylindrical chambers 18A–18D. The cylindrical chambers 18A–18D are disposed around and in close proximity to the cylinder bores (not shown) such that engine coolant transferred through the cylindrical chambers 18A–18D cools the engine 8 by adsorbing heat generated during combustion and piston reciprocation. The engine coolant in the cylindrical chambers 18A–18D of the block jacket 18 is transferred to the lower cylinder head jacket 20. According to an alternate embodiment of the present invention, engine coolant can be transferred from the inlet channel 16 directly to the lower cylinder head jacket 20 via the nozzles 30A–30D (shown in FIG. 3) such that the block jacket 18 is bypassed.

Referring again to FIG. 3, the function of the lower cylinder head jacket 20 will hereinafter be described. It has been observed that in some high output engines, portions of the cylinder head 12 (shown in FIG. 1) located near the exhaust ports 32, the injector ports 34, and/or the intake ports 36 can accumulate excessive heat and cause the engine 8 (shown in FIG. 1) to overheat. Therefore, the present invention is configured to direct coolant flow from the cylinder block 10 (shown in FIG. 1) into the lower cylinder head 12 such that these areas receive engine coolant. The engine coolant is transferred from the cylinder block 10 to the cylinder head 12 via the nozzles 30A–30D which respectively receive engine coolant from a corresponding chamber 18A–18D. The coolant flow through the lower cylinder head jacket 20 will hereinafter be described with respect to nozzle 30A, however, it should be appreciate that the nozzles 30A–30D operate similarly.

Engine coolant is transferred from nozzle 30A through the transfer channel 38A toward an injector port 34 and into the cavity 40A. As the transfer channel 38A is disposed between and in close proximity to a pair of adjacent exhaust ports 32, the engine coolant flowing through the transfer channel 38A provides cooling to a portion of the lower cylinder head 12 (shown in FIG. 1) near the adjacent exhaust ports 32. As the cavity 40A is in close proximity with and partially circumscribes an injector port 34, the engine coolant flowing from the transfer channel 38A into the cavity 40*a*, as well as the coolant flowing through the cavity 40A, provides cooling to a portion of the cylinder head 12 near the injector port 34. The first, second and third flow paths F1, F2 and F3 of the cavity 40A are adapted to provide cooling to a portion of the cylinder head 12 near a pair of adjacent intake ports 36. More precisely, as shown in FIG. 3, the flow paths F1 and F3 direct engine coolant and thereby provide cooling to a portion of the cylinder head 12 located near one of one of the adjacent intake ports 36. The flow path F2 directs engine coolant and thereby provides cooling to a portion of the cylinder head 12 located between the adjacent intake ports 36.

The engine coolant is transferred from the lower cylinder head jacket 20 to the upper cylinder head jacket 22 (shown in FIG. 2) via the transfer passages 42. More precisely, the flow paths F1, F2 and F3 direct coolant from the lower cylinder head jacket 20 through the transfer passages 42 and into the upper cylinder head jacket 22. As coolant flows through the upper cylinder head jacket 22, a portion of the cylinder head 12 (shown in FIG. 1) located near the upper cylinder head jacket 22 is cooled. The coolant flow is transferred from the upper cylinder head jacket 22 and out of the engine 8 (shown in FIG. 1). According to a preferred embodiment, the engine coolant from the jacket 22 is transferred out of the engine 8, passed through a radiator (not shown) to remove adsorbed heat, and is thereafter transferred back to the coolant reservoir 26 (shown in FIG. 2).

While the best modes for carrying out the invention have been described in detail, those familiar with the art to which this invention relates will recognize various alternative designs and embodiments for practicing the invention within the scope of the appended claims.

The invention claimed is:

1. An engine cooling apparatus comprising:

a cylinder block defining an inlet passage; and a cylinder head mounted to the cylinder block, said cylinder head defining:

a lower cylinder head jacket including a plurality of nozzles in fluid communication with said inlet passage, a plurality of transfer channels each in fluid communication with one of the plurality of nozzles, and a plurality of cavities each in communication with one of the plurality of transfer channels, wherein:

each of said plurality of transfer channels is configured to transfer engine coolant between a pair of adjacent exhaust ports, each of said plurality of cavities defines a plurality of flow paths configured to direct engine coolant to an injector port and a plurality of intake ports, and said plurality of nozzles are configured to direct engine coolant to said plurality of transfer channels; and an upper cylinder head jacket in fluid communication with said lower cylinder head jacket.

2. The engine cooling apparatus of claim 1, wherein said cylinder block defines a block jacket in fluid communication with said inlet passage and said plurality of nozzles.

3. The engine cooling apparatus of claim 2, wherein said plurality of nozzles are further configured to direct pressurized engine coolant to portions of the cylinder head located proximate to at least one of a plurality of exhaust ports, a plurality of injector ports, and a plurality of intake ports.

4. The engine cooling apparatus of claim 3, further comprising a plurality of conduits defined by said cylinder block, said plurality of conduits disposed in fluid communication with said inlet passage and said block jacket of said cylinder block to facilitate the transfer of engine coolant therebetween.

5. The engine cooling apparatus of claim 1, wherein said plurality of cavities each define a fist flow path to transfer engine coolant around said of injector port and a second flow path to transfer engine coolant one of around and between said plurality of intake ports.

6. The engine cooling apparatus of claim 5, further comprising a plurality of transfer passages defined by said cylinder head, said plurality of transfer passages disposed in fluid communication with said lower cylinder head jacket and said upper cylinder head jacket to facilitate the transfer of engine coolant therebetween.

7. The engine cooling apparatus of claim 5, wherein said second flow path transfers engine coolant around said plurality of intake ports, and wherein each of said plurality of cavities further defines a third flow path to transfer engine coolant between said plurality of intake ports.

8. An engine cooling apparatus comprising:

a cylinder block defining an inlet passage and a block jacket in fluid communication with said inlet passage; and a cylinder head mounted to the cylinder block, said cylinder head defining:

a lower cylinder head jacket including a plurality of nozzles in fluid communication with said inlet passage, a plurality of transfer channels each in fluid communication with one of the plurality of nozzles, and a plurality of cavities each in communication with one of the plurality of transfer channels, wherein:

each of said plurality of transfer channels is configured to transfer engine coolant between a pair of adjacent exhaust ports, each of said plurality of cavities defines a plurality of flow paths configured to direct engine coolant to an injector port and a plurality of intake ports, and said plurality of nozzles configured to direct pressurized engine coolant to said plurality of transfer channels; and an upper cylinder head jacket in fluid communication with said lower cylinder head jacket, said upper cylinder bead jacket configured to facilitate the cooling of an upper portion of the cylinder head and thereafter to transfer the engine coolant out of the engine.

9. The engine cooling apparatus of claim 8, further comprising a plurality of conduits defined by said cylinder block, said plurality of conduits disposed in fluid communication with said inlet passage and said block jacket of said cylinder block to facilitate the transfer of engine coolant therebetween.

10. The engine cooling apparatus of claim 8, wherein said plurality of cavities each define a first flow path to transfer engine coolant around said of injector port and a second flow path to transfer engine coolant one of around and between said plurality of intake ports.

11. The engine cooling apparatus of claim 10, further comprising a plurality of transfer passages defined by said cylinder head, said plurality of transfer passages disposed in fluid communication with said lower cylinder bead jacket and said upper cylinder head jacket to facilitate the transfer of engine coolant therebetween.

12. The engine cooling apparatus of claim 10, further comprising a plurality of transfer channels each in fluid communication with one of the plurality of flow paths and in fluid communication with said upper cylinder head jacket, wherein said plurality of transfer channels are each configured to transfer engine coolant between a pair of adjacent exhaust ports and transfer engine coolant to said upper cylinder head jacket.

13. The engine cooling apparatus of claim 10, wherein said second flow path transfers engine coolant around said plurality of intake ports, and wherein each of said plurality of cavities further defines a third flow path to transfer engine coolant between said plurality of intake ports.

14. A method for cooling an engine comprising:

transferring engine coolant from a reservoir to an inlet passage defined by a cylinder block;

transferring the engine coolant from the inlet passage into a plurality of nozzles defined by a cylinder head; and directing the engine coolant in the plurality of nozzles between a pair of adjacent exhaust ports via a transfer channel and around at least one of an injector port and a plurality of intake ports via a cavity defining a plurality of flows paths.

15. The method of claim 14, further comprising transferring engine coolant from the inlet passage into a block jacket defined by the cylinder block.

16. The method of claim 15, further comprising transferring engine coolant from the plurality of nozzles and through a lower cylinder head jacket defined by the cylinder head.

17. The method of claim 16, further comprising transferring engine coolant from the lower cylinder head jacket to an upper cylinder head jacket defined by the cylinder head.

18. An engine cooling apparatus comprising:

a cylinder block defining an inlet passage; and a cylinder head mounted to the cylinder block, said cylinder head defining:

a lower cylinder head jacket including:

a plurality of nozzles in fluid communication with said inlet passage, a plurality of cavities including a plurality of fluid flow paths in fluid communication with said plurality of nozzles, and at least one of a plurality of exhaust ports, a plurality of injector ports, and a plurality of intake ports in fluid communication with the plurality of fluid flow paths, wherein each nozzle is in fluid communication with a respective cavity and each nozzle is configured to direct engine coolant to the plurality of flow paths of its respective cavity to provide cooling to said at least one of said plurality of exhaust ports, said plurality of injector ports, and said plurality of intake ports; and an upper cylinder head jacket in fluid communication with said lower cylinder head jacket.

* * * * *